United States Patent [19]

Baratto et al.

[11] Patent Number: 4,622,765

[45] Date of Patent: Nov. 18, 1986

[54] STRUCTURE OF A DEVICE FOR VARYING THE INCLINATION IN SKI BOOTS

[75] Inventors: Mirko Baratto, Valdobbiadene; Alfio Leonardi, Milan, both of Italy

[73] Assignee: Nordica S.p.A., Montebelluna, Italy

[21] Appl. No.: 769,511

[22] Filed: Aug. 26, 1985

[30] Foreign Application Priority Data

Sep. 6, 1984 [IT] Italy ..... 23030/84[U]

[51] Int. Cl.[4] ..... A43B 5/04

[52] U.S. Cl. ..... 36/120; 36/54

[58] Field of Search ..... 36/117–121, 36/54, 50

[56] References Cited

U.S. PATENT DOCUMENTS

| | | | |
|---|---|---|---|
| 3,868,783 | 3/1975 | Caporicci | 36/120 |
| 4,334,368 | 6/1982 | Chalmers, II et al. | 36/121 |

FOREIGN PATENT DOCUMENTS

| | | | |
|---|---|---|---|
| 0071055 | 2/1983 | European Pat. Off. . | |
| 0117488 | 9/1984 | European Pat. Off. | 36/117 |
| 0133237 | 2/1985 | European Pat. Off. | 36/117 |
| 1810291 | 6/1970 | Fed. Rep. of Germany | 36/54 |

*Primary Examiner*—James Kee Chi

*Attorney, Agent, or Firm*—Guido Modiano; Albert Josif

[57] ABSTRACT

The device for varying the inclination in ski boots comprises, on either of the two mutually movable parts of a ski boot, a detent block releasably lockable at a presettable position of said part and engageable by contact with an abutment detent defined on the other of said parts.

12 Claims, 7 Drawing Figures

STRUCTURE OF A DEVICE FOR VARYING THE INCLINATION IN SKI BOOTS

BACKGROUND OF THE INVENTION

This invention relates to a structure of a device for varying the inclination in ski boots.

As is known, ski boots in their most traditional embodiments comprise a shell to which there is pivotally connected for oscillation about a horizontal axis transverse to the longitudinal direction of the shell, a quarter in the instance of a front entrance ski boot, or possibly a front quarter and a rear quarter in the instance of rear entrance ski boots.

For all these types of ski boots, growing acceptance is being gained by devices which enable the mutual inclination of the quarter(s) on the shell to be adjusted both lengthwise, i.e. on a vertical plane which lies through the longitudinal centerplane of the boot, and the side inclination, i.e. on a vertical plane transverse to the former.

The currently known devices generally require external accessory means for effecting the inclination adjustment, which are unpopular with the users because the accessory elements required to effect the adjustment are liable to get lost and the known devices are generally fairly complicated to adjust.

Another drawback of the prior art approaches is that such inclination adjusting devices are constructionally highly complex and unwieldly, thereby they may alter the traditional configuration of the boot.

SUMMARY OF THE INVENTION

It is the aim of this invention to obviate such prior drawbacks by providing a structure of a device which enables effectuation of the desired adjustment without resorting to accessory elements externally of the boot, and which enables the adjustment to be performed through extremely simple and quick operations.

Within the above general aim, it is a particular object of the invention to provide a device which has a much simplified construction and an extremely reduced bulk, thereby it can be easily accommodated in the boot without the need to modify its intrinsic structure.

Another object of this invention is to provide a structure of a device which is formed with few component elements which can be readily and quickly assembled together.

A not unimportant object of this invention is to provide a structure of a device for varying the inclination in ski boots which has a much reduced cost, thus favoring its widespread acceptance and use.

The above aim, as well as these and other objects to be made apparent hereinafter, are achieved by a structure of a device for varying the inclination in ski boots, according to the invention, characterized in that it comprises, on either of the two mutually movable parts of a ski boot, a detent block lockable releasably in a presettable position of said part and engageable by contact with an abutment detent defined on the other of said parts.

BRIEF DESCRIPTION OF THE DRAWINGS

Further features and advantages will be apparent from the detailed description of a structure of a device for varying the inclination in ski boots, as shown by way of illustration and not of limitation in the accompanying drawings, where.

DESCRIPTION OF THE PREFERRED EMBODIMENTS

Figure 1:
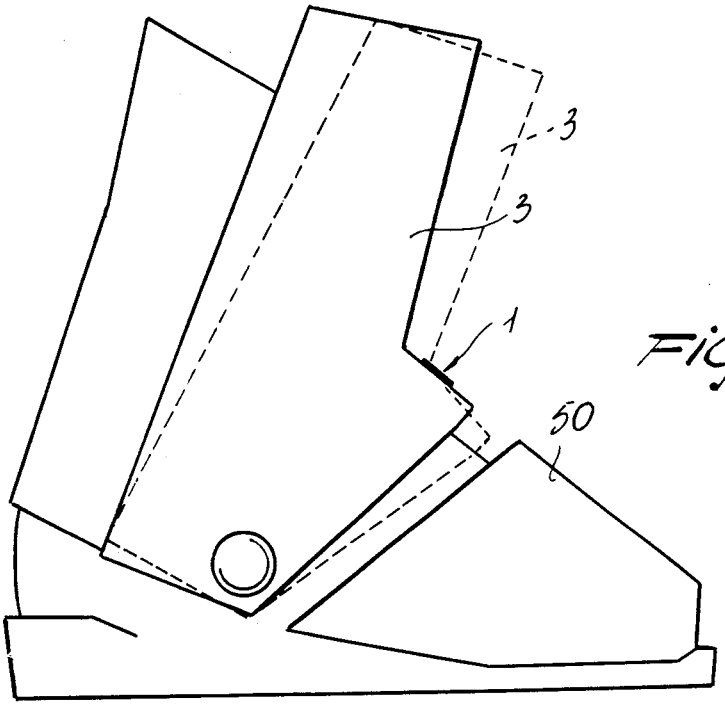
FIG. 1 shows a ski boot, of the rear entrance type, incorporating the device of this invention.
Figure 2:
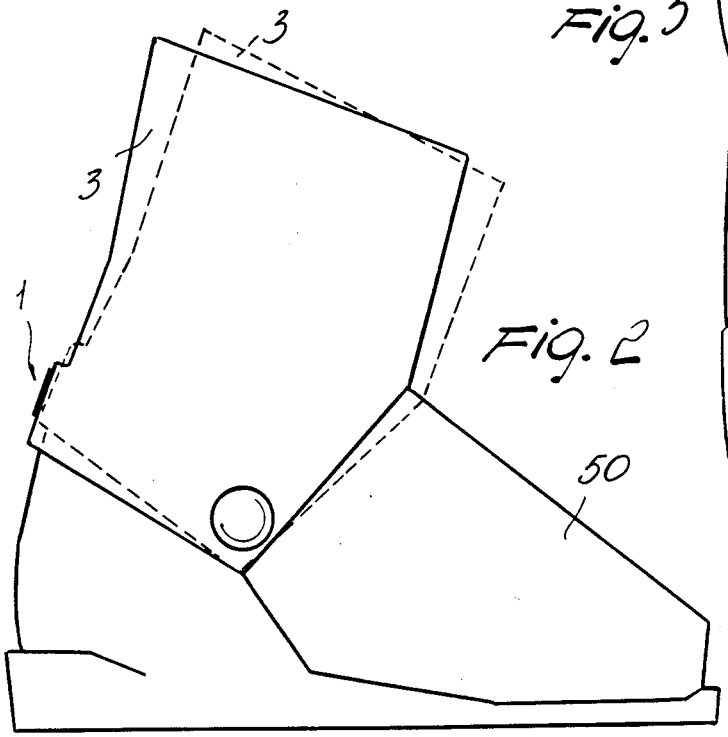
FIG. 2 shows a front entrance ski boot incorporatng the device of this invention.

With reference to the cited drawing figures, a structure of a device for varying the inclination in ski boots, according to the invention, which is generally designated with the reference numeral 1, comprises an engagement or detent block 2 which is associated with either of the mutually movable parts of a ski boot, preferably a generally flat body portion 3*a* of the quarter 3. The block 2 has, at a middle portion thereof, an elongate slit 4 which is laid side-by-side, at its longitudinal edges, with a serration 5.

The cited block 2 is shown to be coupled to the quarter 3 through a stem 10 passed slidably through the elongate slit 4 and terminating in engagement teeth 11 which are removably coupleable with the serration 5.

The stem 10 has, externally of the quarter 3, a pushbutton element 12 which is accessible from the outside. Between the pushbutton element 12 and a recess 14 defined in the quarter, there is active an elastic means comprising a spring 15 which has the function of holding the engagement teeth 11 elastically engaged with the serration 5.

By applying a compressive action to the pushbutton element 12, by translation of the stem 10 along its own axis, the engagement teeth 11 are disengaged from the serration 5 and it becomes possible to provide a mutual sliding movement between the stem and the slit in the block, thereby obtaining a different positioning of the teeth 11 in the serration 5, in order to obtain the desired positioning of the detent block 2 relatively to the quarter.

The block 2 acts in abutting relationship with an abutment detent 40 defined on the other of the two mutually movable parts and in this particular case on a generally flat body portion 50*a* of the shell 50 of the ski boot overlapped by the generally flat body portion 3*a* of the quarter 3.

It should be added to the foregoing that an elastic pusher means 24 is provided which acts between the block 2 and an abutment wing 25 defined by the quarter, which have the function of elastically pushing the block 2 to abut against the abutment detent 40 on effecting the disengagement between the teeth 11 and serration 5.

In practical use, the user, in order to perform a desired adjustment, one simply has to exert a pressure action on the pushbutton 12 to obtain the disengagement of the teeth 11 from the serration 5, and the obtain the desired positioning between the quarter and shell, thereafter on releasing the pushbutton 12, the teeth 11 by engaging in the new position on the serration 5 will retain the set inclination.

It should be also pointed out that the device, as illustrated above, may be applied to the front portion, front quarter or shell of the boot, where it is used to adjust the inclination in rear entrance ski boots, or possibly to the rear portion, where the device is used to adjust the inclination in front entrance ski boots.

Figure 3:
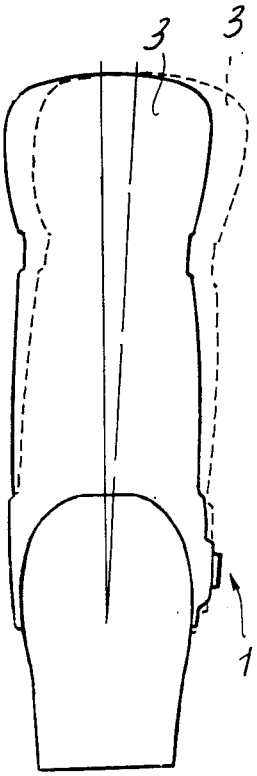
FIG. 3 shows the device of this invention as applied to a ski boot for varying lateral inclination.
Figure 4:
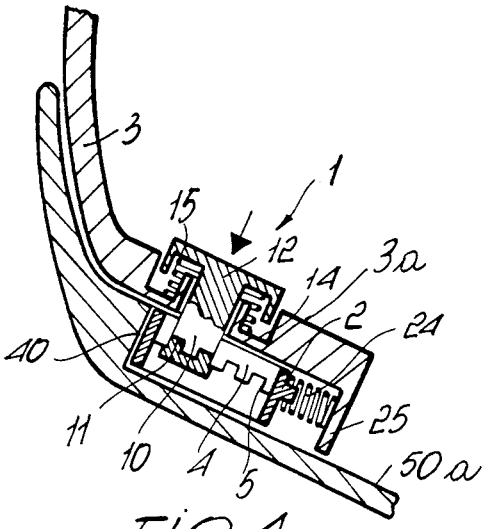
FIG. 4 shows, in section, the device of this invention as applied to a rear entrance ski boot.
Figure 5:
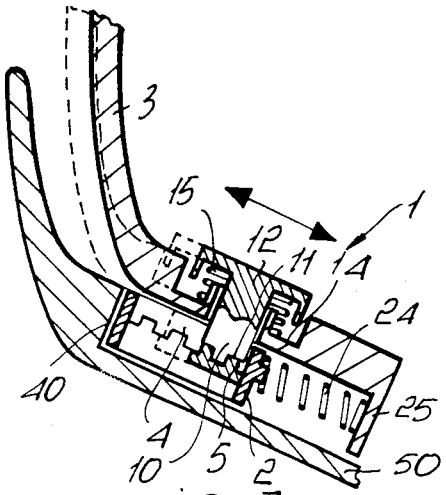
FIG. 5 shows, in section, the device of FIG. 4 in a different operative position thereof.
Figure 6:
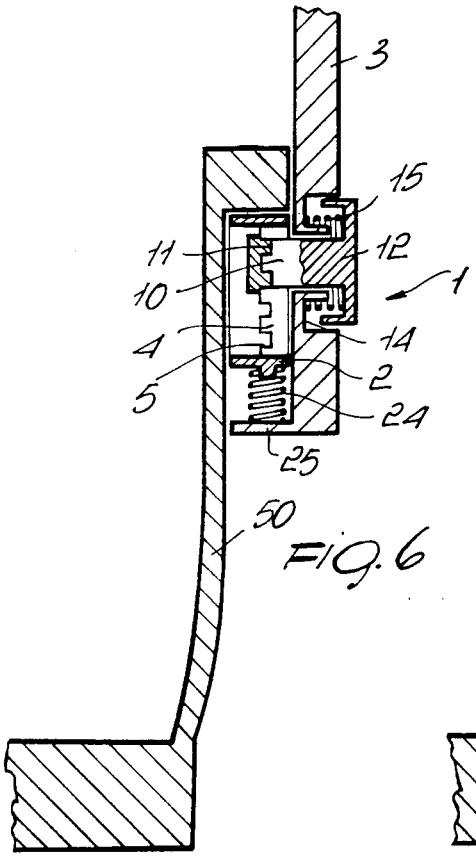
FIGS. 6 and 7 show, in section and in two different operative positions, the device as applied to vary the side inclination.
Figure 7:
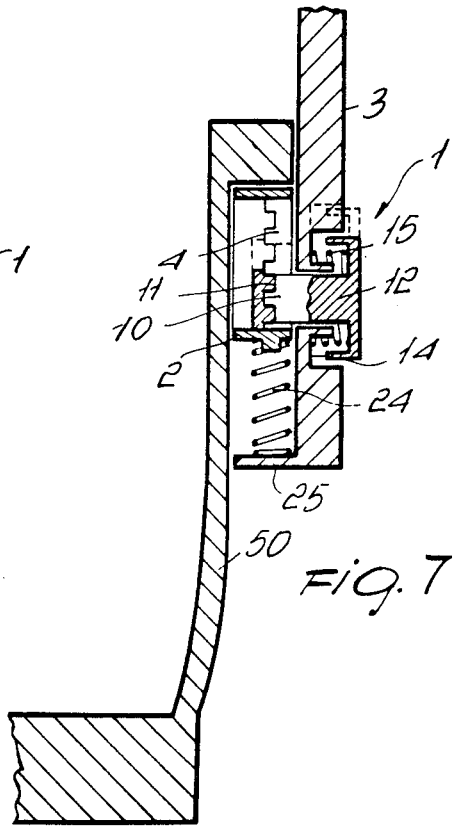

It could be possible to use the device for adjusting the side inclination, as shown diagrammatically in FIG. 3, in which case it is convenient that the block 2 be attached to the shell 50.

It may be seen from the foregoing that the invention achieves the proposed objects, and in particular that the device can be operated by simply acting with a pressure action on the pushbutton 12, without requiring accessory elements or complicated actuations, since the coupling of the detent block is simply effected by engaging the engagement teeth, 11, as provided on the stem 10, with the serration 5 which is provided on the block 2, with the possibility of selecting over a wide range the mutual positioning of the teeth 11 and serration 5.

Another important aspect is the fact that a set inclination would be retained without involving the use of any special locking devices, but by merely exploiting the elastic action which, by urging the pushbutton 12 outwards, holds the teeth 11 engaged with the serration 5.

In practicing the invention, the materials used, so long as compatible with the specific use, and the dimensions and contingent shapes may be any ones meeting individual application requirements.

What is claimed is:

1. A structure of a device for varying the inclination in ski boots, including two mutually movable parts, said device comprising at least an engagement block and an abutment detent, said engagement block being releasably lockable in a presettable position of one of said two mutually movable parts and engageable with said abutment detent, defined on the other of said two mutually movable parts.

2. A structure of a device for varying the inclination in ski boots, according to claim 1, wherein said engagement block is connected to one of said two mutually movable parts by releasable locking means, said releasable locking means comprising a slit having edges and a serration and a stem having engagement teeth, said slit being provided on said engagement block and having at said edges thereof said serration, wherewith said engagement teeth are engageable, said engagement teeth being rigid with said stem adapted to be passed through said elongate slit and being supported on an other of said two mutually movable parts.

3. A structure of a device for varying the inclination in ski boots, according to claim 2, wherein said stem has an outward end and said device further comprises pushbutton element elastic means, and a recess, said pushbutton element being provided at said outward end of said stem, said elastic means being adapted to act between said pushbutton element and said recess defined by one of said two mutually movable parts for holding said engagement teeth engaged with said serration.

4. A structure of a device for varying the inclination in ski boots, according to claim 1, further comprising an elastic pusher means and an abutment wing, said elastic pusher means being adapted for acting between said engagement block and said abutment wing, defined by one of said two mutually movable parts for elastically urging said engagement block against said agbutment detent with said engagement block disengaged from releasable locking means.

5. A structure of a device for varying the inclination in ski boots, according to claim 2, further comprising elastic means and wherein said stem is axially slidable against bias force of said elastic means for disengaging said engagement teeth from said serration.

6. A structure of a device for varying the inclination in ski boots, according to claim 1, wherein said engagement block is positioned on a front quarter portion of a ski boot and said abutment detent is positioned on a shell portion of said ski boot.

7. A structure of a device for varying the inclination in ski boots, according to claim 1, wherein said engagement block is associated with a rear portion of a ski boot quarter and said abutment detent is defined rearwardly on a shell portion of the ski boot.

8. A structure of a device for varying the inclination in ski boots, according to claim 1, wherein said engagement block is provided at an area of pivotal connection between said two mutually movable parts of a ski boot.

9. A structure of a device for varying inclination with respect to each other of two parts of a ski boot, said two parts being mutually adjustably movable in at least one direction, the device comprising:

a first generally flat body portion of a first of said two mutually adjsutably movable parts, a second generally flat body portion of a second of said two mutually adjustably movable parts, said first and said second body portions overlapping each other and each having surface formations defining together a seat and opposite spaced apart abutment surfaces within said seat, a block-like detent body movable in said one direction within said seat between said opposite abutment surfaces, a push button member on one of said generally flat body portions and extending into the reach of said block-like detent body for adjustable engagement therewith in a selected relative position thereof thereby to limit relative adjustment movement in said one direction and allow limited movement in a direction opposite to said one direction.

10. A device according to claim 9, wherein said block-like detent body has a longitudinal slit extending in said one direction and serration formations thereon and wherein said push button member has a stem slidable within said slit, said stem having tooth formations for releasable selected engagement with said serrations and wherein said device further comprises spring means between said block-like detent body and one of said opposite abutment surfaces to thereby bias said block-like detent body.

11. A device according to claim 10, wherein said push button member has spring means for biasing said tooth formations engagement position with said serrations.

12. A structure of a device for varying inclination with respect to each other of two parts of a ski boot, said two parts being mutually adjustably movable in at least one direction, the device comprising:

a first generally flat body portion of a first of said two mutually adjsutably movable parts, a second generally flat body portion of a second of said two mutually adjustably movable parts, said first and said second body portions overlapping each other and each having surface formations defining together a seat and opposite spaced apart abutment surfaces within said seat, a block-like detent body movable in said one direction within said seat between said opposite abutment surfaces, said block-like detent body having a longitudinal slit extending in said one direction and serration formations thereon, spring means within said seat and biasing said block-like detent body, a push button member on one of said generally flat body portions, said p ush button having a stem with tooth formations thereon, said stem extending slidably through said slit for removable engagement with said serrations for adjustable engagement therewith in a selected relative position thereof thereby to limit relative adjustment movement in said one direction and allow limited movement in a direction opposite to said one direction.

* * * * *